United States Patent [19]

Mammel et al.

[11] Patent Number: 4,534,776

[45] Date of Patent: Aug. 13, 1985

[54] AIR CLEANER

[75] Inventors: Lewis H. Mammel, Holmdel; Walter J. Shakespeare, Middletown, both of N.J.

[73] Assignee: AT&T Bell Laboratories, Murray Hill, N.J.

[21] Appl. No.: 635,895

[22] Filed: Jul. 30, 1984

Related U.S. Application Data

[63] Continuation of Ser. No. 408,218, Aug. 16, 1982, abandoned.

[51] Int. Cl.[3] ..... B03C 3/00

[52] U.S. Cl. ..... 55/136; 55/151; 55/385 R; 174/16 R

[58] Field of Search ..... 55/2, 385 R, 124–126, 55/136–138, 151, 154; 174/16 R; 98/33 A; 361/384, 226

[56] References Cited

U.S. PATENT DOCUMENTS

| | | | |
|---|---|---|---|
| 1,628,906 | 5/1927 | Bryne . | |
| 2,867,285 | 1/1959 | Wintermute . | |
| 2,906,369 | 9/1959 | Lagarias . | |
| 3,357,159 | 12/1967 | Drenning | 55/154 |
| 3,771,293 | 11/1973 | Vest . | |
| 4,164,901 | 8/1979 | Everett | 98/33 A |

FOREIGN PATENT DOCUMENTS

| | | | |
|---|---|---|---|
| 215135 | 11/1941 | Switzerland | 55/137 |
| 699670 | 11/1953 | United Kingdom | 55/138 |

*Primary Examiner*—Bernard Nozick

*Attorney, Agent, or Firm*—Ronald D. Slusky

[57] ABSTRACT

Relatively dust-free air to cool electronic equipment, for example, is provided by apparatus which includes at least first and second rows of filamentary electrodes disposed in an air stream and aligned with its direction of flow. Alternate rows of electrodes are connected to respective electric potentials, the potentials and the electrodes being such as to create a net positive space charge between the rows. This causes dust particles in the air stream to acquire a positive charge and thus to move toward the more negative row(s) under the influence of the electric field set up by the potential difference between the rows. This, in turn, results in the creation of streams of clean and dirty air. These are then separated by a baffle having channels which are substantially aligned with the rows of electrodes. The clean air is directed into an enclosure housing the equipment to be cooled. The dirty air is discharged back into the atmosphere, e.g., back into the room in which the equipment is located.

6 Claims, 2 Drawing Figures

AIR CLEANER

This is a continuation of application Ser. No. 408,218 filed Aug. 16, 1982, now abondoned.

BACKGROUND OF THE INVENTION

The present invention relates to the cooling of electronic equipment.

Present cooling requirements for electronic equipment often necessitate the use of forced convection. Room air is forced through the equipment by a fan and may deposit dust on circuit paths and components. This dust or other contaminants will, for example, reduce the effectiveness of heat transfer and bridge over circuit paths or component leads, resulting in such problems as corrosion, deterioration of reliability, noise and cross-talk. Although filters may be used to minimize the deposition of dust, these, disadvantageously, must be replaced manually on a periodic basis.

Electrostatic precipitators have been used previously to control dust accumulation, although not, to our knowledge, in electronic equipment cooling. Prior art electrostatic precipitators operate by charging the dust particles and then collecting them on a metallic surface. If the collection surfaces are not regularly cleaned, however, the efficiency falls and the requirement that the collection surfaces be cleaned is itself disadvantageous. Manual labor to perform this function is expensive, while the use of mechanical devices to clean the collection surfaces adds to the cost and complexity of the equipment.

SUMMARY OF THE INVENTION

In accordance with the present invention, dust in at least a first region of an air stream is moved into at least a second region of the air stream so that the first region is comprised of relatively clean air and the second region is comprised of relatively dirty air. The clean air is used, for example, to cool electronic equipment while the dirty air is discharged back into the atmosphere, e.g., back into the room in whicch the equipment is located.

There are a number of advantages to this approach. Since the dust particles are not collected, no moving parts or human labor are required to keep the electrode surfaces clean and efficient. If a loss of performance occurs because of power supply failure or unusually high dust concentration, etc., the flow of coolant is not impeded and the system fails safe. Filters and filter maintenance may well be eliminated.

In an illustrative embodiment of the invention, at least first and second rows of filamentary electrodes are disposed in the air stream and aligned with its direction of flow. Alternate rows of electrodes are connected to respective electric potentials, the potentials and the electrodes being such as to create a net positive space charge between the rows. This causes the dust particles to acquire a positive charge and thus to move toward the more negative row(s) under the influence of the electric field set up by the potential difference between the rows. This, in turn, results in the creation of regions of clean and dirty air. These are then separated by a baffle having channels which are substantially aligned with the rows of electrodes.

DETAILED DESCRIPTION

Figure 1:
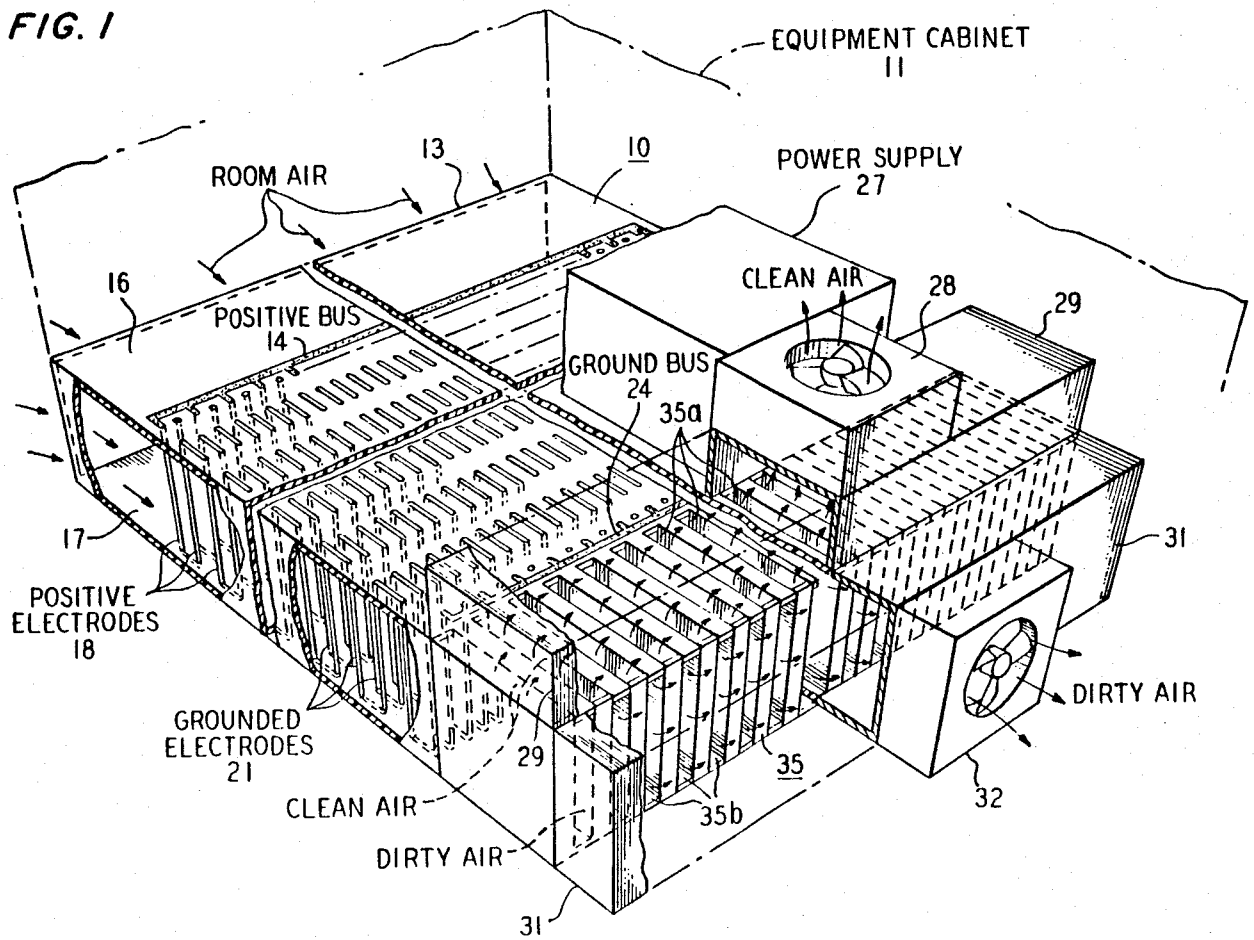
FIG. 1 is a perspective view, fragmentarily sectioned into four pieces, of apparatus embodying the principles of the present invention.

FIG. 1 depicts an electronic equipment enclosure, or cabinet, 11 at the bottom of which is installed an air cleaner 10 embodying the principles of the present invention. In particular, one or more fans 28 and one or more fans 32 create an intake stream of dust-laden room air which enters cabinet 11 through a grill (not visible) disposed on side 13 of the cabinet. Within the air cleaner, the dust in at least one region of the air stream is moved into at least a second region of the air stream so that the first region is comprised of relatively clean air and the second region is comprised of relatively dirty air. The dirty air is discharged back into the atmosphere, i.e., the room in which the cabinet is situated, by fans 32. The clean air is directed upward into the equipment cabinet by fans 28.

More specifically, as seen in FIG. 1, air cleaner 10 includes top and bottom surfaces 16 and 17 which are made of a non-conducting material such as plastic. Extending between the top and bottom surfaces are a plurality of filamentary electrodes arranged in rows which are disposed in the air stream and extend from near side 13 back to a baffle 35 and are thus aligned with the direction of flow of the air stream. Illustratively, each row of electrodes is formed by threading a continuous wire filament through surfaces 16 and 17. Alternate rows of electrodes are connected to respective electrical potentials via respective busses running along top surface 16. In particular, the first, third, fifth, etc., rows of electrodes—designated as positive electrodes 18—are connected to the positive terminal (not visible) of a power supply 27 via positive bus 14. Similarly, the rows interleaved with the positive electrode rows, i.e., the second, fourth, sixth, etc., rows of electrodes—designated the grounded electrodes 21—are connected to the ground terminal (not visible) of the power supply via ground bus 24.

As will be described in further detail hereinbelow, the potentials on, and spacings between, electrodes 18 and 21 are such as to concentrate the dust within the air taken into the air cleaner into a plurality of regions of dirty air. These enter respective channels **35*b* of baffle 35, each of which is substantially aligned with a respective row of grounded electrodes 21. Channels 35*b* are closed off on the top and open on the side so that the dirty air enters a plenum 31. From there it is discharged back into the atmosphere via fans 32** as previously mentioned.

The concentrating of dust into the above-mentioned dirty regions concurrently creates a plurality of steams of relatively clean air. These enter respective channel **35*a* of baffle 35, each of which is substantially aligned with a respective row of positive electrodes 18. Channel 35*a* are closed off on the side and open on the top so that the clean air enters a plenum 29. From there it is directed, as previously noted, up into equipment cabinet 11 via fans 28**.

Figure 2:
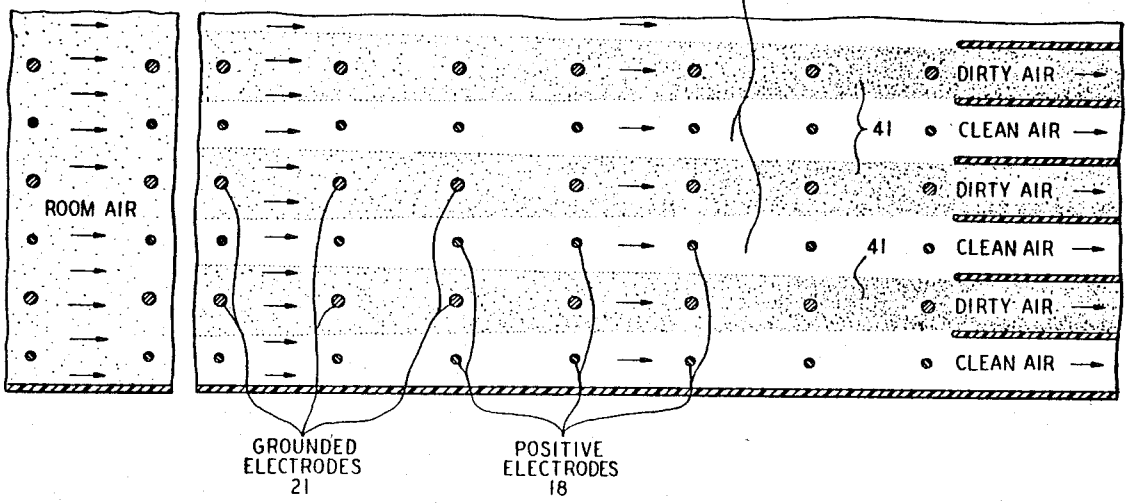
FIG. 2 is a top cutaway view of a portion of the apparatus of FIG. 1.

The theory of operation of the air cleaner will now be presented with reference to FIG. 2.

In particular, the positive potential on electrodes 18 is relatively large, e.g., 5–7 kV. This creates a strong electric field from each row of positive electrodes to the adjacent rows of grounded electrodes. The electrodes themselves are sufficiently fine as to create a positive corona (region of positive air ions) around each positive electrode and a negative corona (region of negative air ions) around each grounded electrode. In addition, the positive electrodes are finer, i.e., have smaller cross sections, than the negative electrodes. As a result, the positive coronas are more intense than the negative coronas. Thus a net positive space charge is maintained throughout the device. This causes the dust particles to acquire a positive charge and the above-mentioned field exerts electrostatic force on the particles which causes them to move toward the negative electrodes.

When a particle approaches the negative corona of a grounded electrode, its charge is neutralized, thus preventing the dust particles from being collected by and adhering to the grounded electrodes. Instead, the dust is concentrated into a plurality of regions of dirty air 41 substantially collinear with the rows of grounded electrodes, which regions become narrower and narrower as the air moves to the right—illustratively at a rate of 1–2 meters/sec. (This narrowing occurs gradually over the length of the air cleaner—much more gradually than the exaggerated narrowing shown, for purposes of illustration, in FIG. 2.) Since channels **35*b* of baffle 35 are substantially aligned with the rows of grounded electrodes, the dirty air tends to flow into those channels rather than channels 35*a***.

As previously mentioned, the concentrating of the dust into the dirty air regions concurrently creates a plurality of regions of relatively clean air 42 substantially collinear with the rows of positive electrodes. Since channels **35*a* of baffle 35 are substantially aligned with the rows of positive electrodes, the clean air tends to flow into those channels rather than into channels 35*b***.

For pictorial purposes, FIG. 2 shows all of the dust passing into channels **35*b*. In reality, this is not the case. Rather, some dust remains in the clean regions and passes into channels 35*a***. However, the concentration of dust in the clean regions is, nonetheless, substantially less, e.g., one half, that of the room air.

Illustrative dimensions within air cleaner 10 are as follows: diameter of positive electrodes 18, 12.7 microns; diameter of electrodes 21, 50.8 microns; distance between rows of electrodes, 10 mm; distance between electrodes within each row, 20 mm; width of each channel in baffle 35, 10 mm; height of baffle 35, 50 mm; length of electrode rows (from bus 14 to bus 24), 250 mm; overall width of air cleaner 10, 340 mm.

What is claimed is:

1. Apparatus for providing air to an enclosure located within a room, said apparatus comprising a housing, means within said housing adapted to be in communication with said room for creating a stream of air taken from said room, said stream being laden with dust, means within said housing for moving dust that is in at least a first longitudinal region of said air stream transversely to the direction of flow of said air stream into at least a second longitudinal region of said air stream, said second region being contiguous in said air stream to said first region, said dust moving means comprising first and second interleaved pluralities of rows of electrodes disposed in said first and second regions, respectively, and means for connecting the electrodes of said first and second pluralities to respective electrical potentials, baffle means within said housing for separating said first and second regions to form streams of clean and dirty air, respectively, said dirty stream being more laden with dust than said clean stream and said baffle means having formed therein at least first and second channels aligned with said first and second regions, respectively, and output means for directing said clean air into said enclosure and for discharging into said room said dirty air and substantially all of said dust that is not in said clean stream.

2. The invention of claim 1 wherein said electrodes are filamentary electrodes and the electrodes of the first plurality rows have smaller cross sections than the electrodes of the second plurality rows.

3. The invention of claim 1 wherein said electrodes are filamentary electrodes and the electrodes of the first plurality rows have smaller cross sections than the electrodes of the second plurality rows.

4. Apparatus for providing air to an enclosure located within a room, said apparatus comprising a housing, means within said housing adapted to be in communication with said room for creating a stream of air taken from said room, said stream being laden with dust, means within said housing for moving dust that is in at least a first longitudinal region of said air stream transversely to the direction of flow of said air stream into at least a second longitudinal region of said air stream, said second region being contiguous in said air stream to said first region, said dust moving means comprising first and second interleaved pluralities of rows of electrodes disposed in said first and second regions, respectively, and means for establishing the electrodes of said first and second pluralities at first and second potentials, respectively, said first potential being more positive than said second potential, said potentials and said electrodes being such as to create a net positive space charge between each first plurality row and the adjacent second plurality row, baffle means within said housing for separating said first and second regions to form streams of clean and dirty air, respectively, said dirty stream being more laden with dust than said clean stream and said baffle means having formed therein at least first and second channels aligned with said first and second regions, respectively, and output means for directing said clean air into said enclosure and for discharging into said room said dirty air and substantially all of said dust that is not in said clean stream.

5. Apparatus for providing air to an enclosure located within a room, said aparatus comprising a housing, means within said housing adapted to be in communication with said room for creating a stream of air taken from said room, said stream being laden with dust, first and second interleaved pluralities of rows of electrodes within said housing disposed in said air stream and aligned with its direction of flow, means for establishing the electrodes of said first and second rows at first and second electric potentials, respectively, said first potential being more positive than said second potential, said potentials and said electrodes being such as to create a net positive space charge between each row and the adjacent row so that first portions of said air stream which are substantially collinear with the rows of said first plurality have a lesser concentration of said dust than second portions of said air stream which are substantially collinear with the rows of said second plurality, and means within said housing including baffle means having formed therein first and second pluralities of channels aligned with the rows of said first and second pluralities of rows of electrodes for directing said first portions into said enclosure and for directing said second portions and substantially all of said dust that is not in said first portions into said room.

6. The invention of claim 5 wherein said electrodes are filamentary electrodes and the cross sections of the electrodes of said first plurality of rows are smaller than the cross sections of the electrodes of said second plurality of rows.

* * * * *